United States Patent [19]

Tucker et al.

[11] Patent Number: 5,007,652

[45] Date of Patent: Apr. 16, 1991

[54] LACROSSE STICK

[75] Inventors: Richard B. C. Tucker, Baltimore; Jackie L. Davis, Aberdeen; Fielding H. Lewis, Jr., Queenstown, all of Md.

[73] Assignee: Wm. T. Burnett & Co., Inc., Baltimore, Md.

[21] Appl. No.: 550,562

[22] Filed: Jul. 10, 1990

Related U.S. Application Data

[63] Continuation-in-part of Ser. No. 414,258, Sep. 29, 1989, Pat. No. 4,940,243.

[51] Int. Cl.[5] ..... A63B 59/02

[52] U.S. Cl. ..... 273/326

[58] Field of Search ..... 273/326, 73 C, 73 D

[56] References Cited

U.S. PATENT DOCUMENTS

| | | | |
|---|---|---|---|
| 1,179,435 | 4/1916 | Hutchinson | 273/73 D |
| 3,507,495 | 4/1970 | Tucker et al. | 273/326 |
| 3,822,062 | 7/1974 | Tucker et al. | 273/326 |
| 3,905,088 | 9/1975 | Tucker et al. | 273/326 |
| 3,966,207 | 6/1976 | Pass | 273/73 D |
| 4,034,984 | 7/1977 | Crawford et al. | 273/326 |
| 4,037,841 | 7/1977 | Lewis, Jr. | 273/326 |
| 4,097,046 | 6/1978 | Friant | 273/326 |
| 4,138,111 | 2/1979 | Rule | 273/326 |
| 4,206,918 | 6/1979 | Lewis, Jr. | 273/326 |
| 4,739,994 | 4/1988 | Lewis, Jr. | 273/326 |
| 4,861,042 | 8/1989 | Trettin | 273/326 |
| 4,940,243 | 7/1990 | Tucker et al. | 273/326 |

*Primary Examiner*—William H. Grieb

*Attorney, Agent, or Firm*—Breiner & Breiner

[57] ABSTRACT

A double-wall synthetic lacrosse stick including tab means for attachment or formation of the web on the head of the lacrosse stick is described. The tab means include a slot for snapping a string of the web into place. The slot is constructed and arranged to hold the web securely.

4 Claims, 2 Drawing Sheets

LACROSSE STICK

RELATED APPLICATION

This application is a continuation-in-part of co-pending application U.S. Ser. No. 07/414,258 filed Sept. 29, 1989 now U.S. Pat. No. 4,940,243, granted July 10, 1990.

FIELD OF INVENTION

This invention relates to lacrosse sticks, and more particularly to new and novel means for attaching a webbing to a lacrosse stick head to provide advantages over the prior art.

BACKGROUND OF THE INVENTION

In the early prior art, lacrosse sticks were customarily made of wood, usually hickory, shaped by American Indians with whom the game originated. Such lacrosse sticks lacked uniformity as to quality, strength, weight, and feel in the hands of a player.

To overcome the disadvantages of the prior art, great strides have been made in the recent past in the construction of lacrosse stick heads and handles. For example, U.S. Pat. Nos. 3,507,495; 3,822,062, and 3,905,088 to Tucker et al; and U.S. Pat. No. 4,034,984 to Crawford et al disclose elastomeric lacrosse stick heads and parts therefor which are highly resilient and have dramatically revolutionized the sport of lacrosse. Additionally, U.S. Pat. Nos. 4,739,994; 4,037,841, and 4,206,918 to Lewis disclose novel plastic and metal lacrosse stick handles which have further enhanced the quality of lacrosse sticks. Accordingly, it is now common for lacrosse stick heads and handles to be interchangeable in order to suit the needs of a player, or for repair of a broken head or handle.

The prior art in above-noted U.S. Pat. No. 4,034,984 teaches the attachment of a webbing to a lacrosse stick head through tab means. As apparent from FIG. 2 of the '984 patent, each tab comprises a string hole, requiring that the webbing be strung through the holes. This patent provides a convenient method of attaching the webbing, particularly a mesh webbing. However, at times the stringing of the webbing through the holes is time-consuming. The present invention avoids this time-consuming procedure.

PRIMARY OBJECTS AND GENERAL DESCRIPTION OF INVENTION

It is a primary object of the present invention to provide a new and novel means of attaching a webbing to a lacrosse stick head which is rapid and secure.

Other objects and advantages of the present invention will become apparent from the following general and detailed description of the invention taken in conjunction with the appended drawing.

Briefly, the objects of the present invention are accomplished in a first preferred embodiment of the invention which provides for a lacrosse stick having a head with a generally V-shaped frame adapted to receive a web. A transverse stop extends between the side walls of the head and cooperates with a throat portion to facilitate connection of the head to the handle. The throat portion includes an opening in the transverse stop for receiving a snap-in retainer means. The retainer means is comprised of a base having one or more longitudinally extending prongs which are adapted to extend through the throat portion and engage with slots in the handle, thereby attaching the head to the handle.

A second embodiment of the invention includes a lacrosse stick comprising a handle having a clip mounted at one end of the handle and having protuberances extending outwardly therefrom for connectively engaging the head, and a head having a throat portion adapted to receive the handle. The protuberances of the handle connectively engage the throat portion of the head to attach the handle to the head.

A third embodiment of the invention includes a lacrosse stick comprising a lacrosse stick head having tab means for attachment of a webbing to the lacrosse stick head. The tab means have a slot therein to permit a web string to be snapped into said tab. The slot is constructed and arranged, however, to securely retain the string once it is snapped in place.

DRAWING AND DETAILED DESCRIPTION

Figure 1:
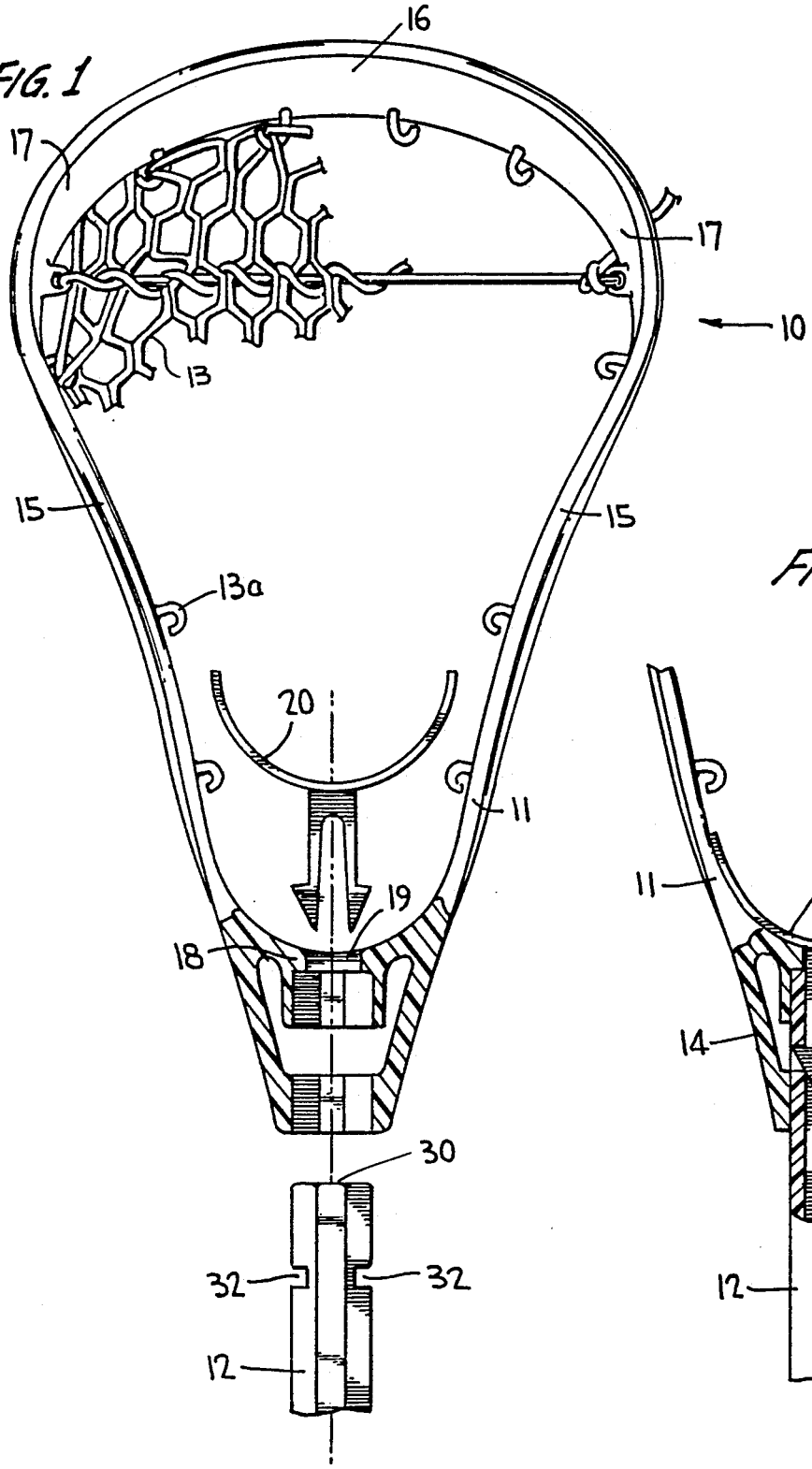
FIG. 1 is a first embodiment illustrating a front exploded elevational view of a lacrosse stick head, partly in section; the snap-in retainer, the handle, and the tab arrangement and construction.

The illustrated embodiment of the invention is a lacrosse stick generally designated 10 which includes a head generally designated 11 and a handle generally designated 12. The head is provided with webbing or netting partially shown in FIG. 1 and generally indicated at 13.

The head 11 is constructed similarly to a head disclosed in Tucker et al, U.S. Pat. No. 3,507,495; and shown also in later Tucker et al, U.S. Pat. No. 3,822,062. The head 11 is, in general, a closed frame-like construction of somewhat V-shaped design, preferably substantially symmetrical. The lower end of the head is formed as a throat 14 from which two side walls 15,15 are inclined and diverged upwardly and outwardly. The upper ends of the side walls 15,15 are connected by a transverse top or end wall 16 which merges with the side walls through intervening smoothly curved portions 17,17.

A transverse stop means 18 extends between the side walls 15,15 and cooperates with throat 14 and adjacent portions of the side walls to facilitate the connection of the head 11 and handle 12. The stop 18 has an opening 19 for receiving retainer means 20 of the invention as described in detail hereafter.

The Tucker et al, U.S. Pat. No. 3,822,062 more particularly discloses an arrangement which may be embodied in the webbing 13 shown in FIG. 1 by way of example; and the Crawford et al, U.S. Pat. No.

4,034,984 discloses and claims means for attachment of the webbing on the head as shown in FIG. 1, although it is noted that the tab means 13*a* are open to allow for quicker attachment of the webbing. Since details of construction of the webbing and its attachment per se are not part of the present invention, reference to U.S. Pat. Nos. 3,822,062 and 4,034,984 is, therefore, sufficient as to disclosure of one suitable kind of webbing and attachment.

The head 11, aside from the webbing 13, is preferably formed as a unitary molding of a polymer material characterized by toughness, high impact resistance and good flexibility, as well as other desirable properties explained in the aforesaid U.S. Pat. No. 3,507,495. A presently preferred material is a nylon resin marketed under the DuPont trademark ZTEL ST 801. This polymer has outstanding impact resistance and good moldability, permitting injection molding. Unreinforced ZTEL ST 801, with a water content of 0.2%, at 73° F. using the ASTM test method D638 has a tensile strength of 7800 psi, a yield strength of 7800 psi, and an elongation at break of 40%. It has a specific gravity of 1.09 using the ASTM test method D792, and a Rockwell hardness of R112 using ASTM test method D785. Another preferred material is an injection moldable polymer material sold under the DuPont trademark HYTREL. Still another material suitable for making head 11 is the reaction product of Adiprene L315 and 4,4'-methylene-bis-(2-chloroaniline) using the formulation and manufacturing procedure as set forth in the aforesaid U.S. Pat. No. 3,507,495, the disclosure of the '495 patent being incorporated herein by reference. The above-noted materials are examples of materials suitable for constructing the head found to cooperate admirably with the handle. An additional lacrosse stick head suitable for use with the present invention is disclosed in pending application Ser. No. 06/778,067 filed Sept. 20, 1985 for "Lacrosse Stick Having Open Sidewall Structure," and is incorporated herein by reference.

The handle 12 may be formed of any suitable material including a plastic, metal, or wood. Preferred handles for use with the present invention are disclosed in U.S. Pat. Nos. 4,739,994; 4,206,918, and 4,037,841 to Lewis which are incorporated herein by reference. A preferred handle as shown in the drawing is a hollow octagonal handle having an elliptical cross-section made of plastic.

The present invention, as above-noted, is primarily related to attachment of the head 11 to the handle 12. A first embodiment of the invention, shown in FIGS. 1-6, utilizes a retainer means 20 for attaching the head 11 to handle 12. The retainer means 20 shown in the drawing is a snap-in retainer separate from the head. However, it is understood that the retainer means 20 may be molded integrally with the head 11. As apparent from the drawing, retainer means 20 fits flush with the transverse stop 18 and partly functions as the stop, and at times in this disclosure will be referred to as the stop.

The retainer means 20 comprises a base 22 having longitudinally extending prongs 24,24. As noted above, base 22 is shaped to fit flush with the transverse stop 18 of head 11. The prongs 24,24 include ears 26,26 constructed and arranged to engage handle 12. Prongs 24,24 are constructed such that they are flexible and extend outwardly and away from each other at a distance greater than the diameter of opening 30 of handle 12. Retainer means 20 is preferably made of a plastic, although other suitable materials may be used. Further, it is understood that a different number of prongs may be utilized without departing from the scope of the invention.

Handle 12 includes an opening 30 for insertion of the prongs 24,24 and slots 32,32 for connectively engaging prongs 24,24. Accordingly, to attach head 11 to handle 12, snap-in retainer means 20 is seated flushly on the transverse stop 18 with prongs 24,24 extending through opening 19 of head 11 and ears 26,26 connectively engage slots 32,32 of handle 12.

Figure 4:
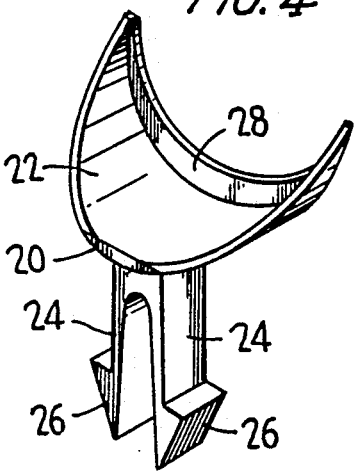
FIG. 4 is a perspective view of another embodiment of the snap-in retainer means of the invention having a stop means.
Figure 5:
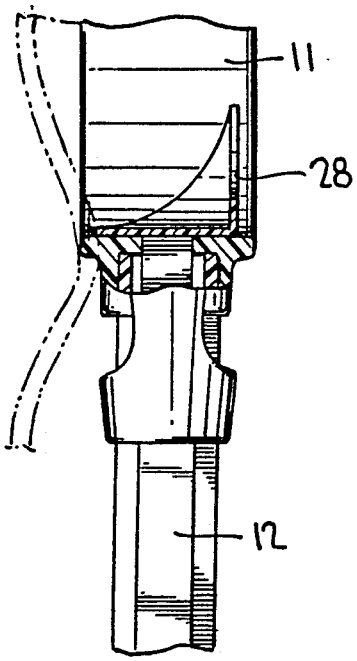
FIG. 5 is a side view, partly in section, of the lacrosse stick showing the head attached to the handle by the snap-in retainer means of FIG. 4.

Referring to FIGS. 4 and 5, retainer means 20 may include a lip 28 which functions as a stop means to hold a lacrosse ball in place in the head 11. Lip 28 may include the trademark of the product manufacturer.

Figure 6:
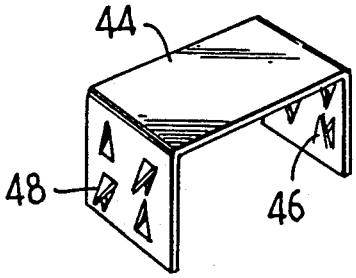
FIG. 6 is a perspective view of a clip for attaching the head to the handle according to another embodiment of the invention.
Figure 7:
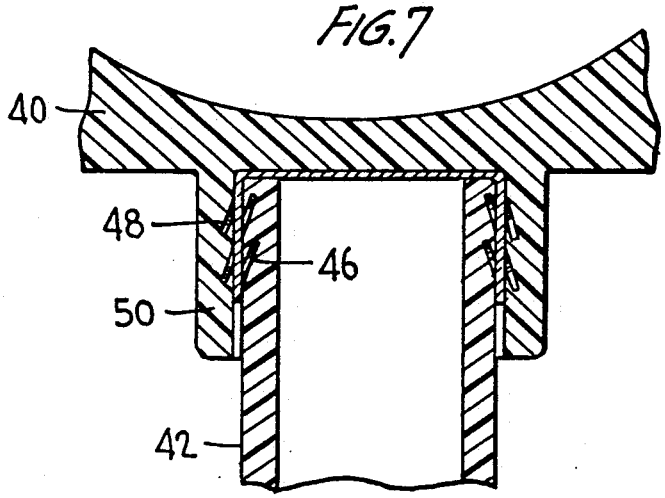
FIG. 7 is a sectional view showing a lacrosse stick head and handle attached by the clip of FIG. 6.

A second embodiment of the invention is disclosed in FIGS. 6 and 7. This embodiment includes a head 40 and a handle 42 constructed similarly to head 11 and handle 12. In this embodiment handle 42 includes a clip 44 mounted thereon by inwardly extending protuberances 46, and further includes outwardly extending protuberances 48. Head 40 includes throat portion 50 made of plastic or other suitable material adapted to receive handle 40 with clip 44. Accordingly, when handle 42 is inserted in throat portion 50 of head 40, protuberances 48 become imbedded in throat portion 50 to attach head 40 to handle 42. In the alternative, throat 50 may include annular ridges (not shown) adapted to engage protuberances 48.

Figure 2:
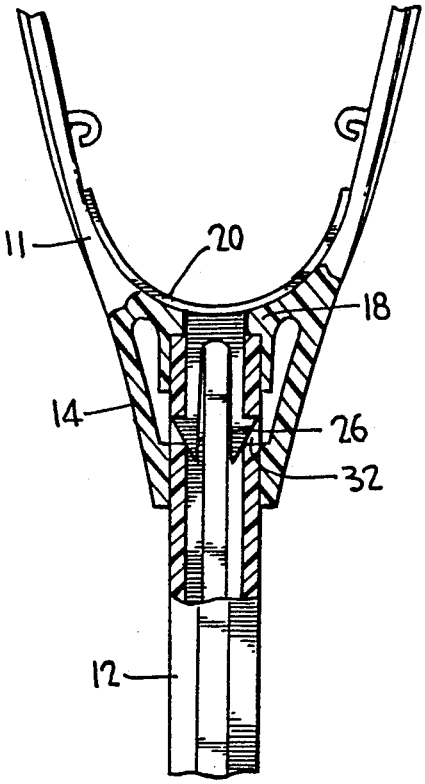
FIG. 2 is a front view of the embodiment of FIG. 1, partly in section, showing the components locked together.
Figure 3:
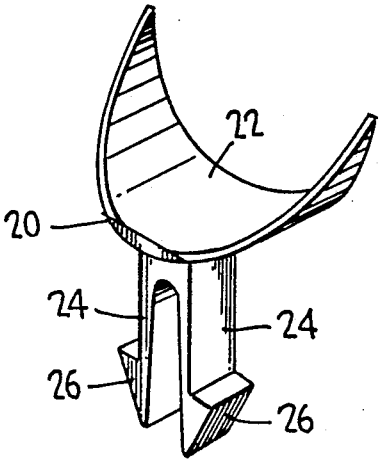
FIG. 3 is a perspective view of one embodiment of the snap-in retainer means of the invention.

In a third embodiment of the invention, as seen primarily from FIG. 1 and 2, the lacrosse stick head includes tab means 13*a* which have a slot which permits a string of the webbing, such as a mesh webbing, to be snapped into the slot. As illustrated, the slot is positioned so as to securely retain the webbing once the webbing string is snapped into the tab. As further shown in FIG. 1, it may be desirable to include at least one tab on each side wall near the transverse end of the stick which does not have a slot, but which is designed to be strung with a retaining string.

Various modifications will be recognized by those skilled in the art based on the present teaching. Thus, although only select preferred embodiments have been specifically illustrated and described herein, it is to be understood that various modifications and embodiments can be utilized to provide the lacrosse stick of the present invention without departing from the spirit of the invention and the scope of the appended claims.

It is claimed:

1. A head for a lacrosse stick comprising a generally V-shaped frame adapted to receive a web, said frame being defined by two side walls joined at a juncture and diverging therefrom, a transverse wall joining the ends of said side walls opposite of said juncture, and tab means positioned on at least said side walls for securement of a web onto said frame, said tab means being integrally formed with at least said side walls, and constructed and arranged to have a slot therein to permit a web string to be snapped into said tab, said slot being constructed and arranged to retain said string.

2. The head for a lacrosse stick according to claim 1 wherein said tab means are also on said transverse wall.

3. A lacrosse stick comprising a head according to claim 1, a web attached to said head, and a handle fitted to the juncture of said side walls.

4. A lacrosse stick head according to claim 1, 2, or 3 wherein said tabs are constructed and arranged with said side walls to project inwardly thereof and being substantially flush with the top surface thereof.

* * * * *